US006681813B2

(12) United States Patent
Baltes

(10) Patent No.: US 6,681,813 B2
(45) Date of Patent: Jan. 27, 2004

(54) DEVICE FOR REMOVING FLUID FROM A CONTAINER

(75) Inventor: Herbert Baltes, Losheim (DE)

(73) Assignee: Hydac Technology GmbH, Sulzbach/saar (DE)

( * ) Notice: Subject to any disclaimer, the term of this patent is extended or adjusted under 35 U.S.C. 154(b) by 0 days.

(21) Appl. No.: 10/182,625

(22) PCT Filed: Jan. 19, 2001

(86) PCT No.: PCT/EP01/00608

§ 371 (c)(1),
(2), (4) Date: Aug. 1, 2002

(87) PCT Pub. No.: WO01/59308

PCT Pub. Date: Aug. 16, 2001

(65) Prior Publication Data

US 2003/0075234 A1 Apr. 24, 2003

(30) Foreign Application Priority Data

Feb. 11, 2000 (DE) ..... 100 06 014

(51) Int. Cl.[7] ..... B65B 31/04

(52) U.S. Cl. ..... 141/65; 141/44; 141/45; 141/52; 141/100

(58) Field of Search ..... 141/45, 44, 52, 141/53, 65, 100; 137/590, 198, 212, 210, 170.1

(56) References Cited

U.S. PATENT DOCUMENTS

| | | | | | |
|---|---|---|---|---|---|
| 537,939 | A | * | 4/1895 | Savage | 141/44 |
| 1,279,216 | A | | 9/1918 | Antnony | 137/210 |
| 1,576,662 | A | | 3/1926 | Leonard | 137/212 |
| 1,838,286 | A | | 12/1931 | Rudat | 137/212 |
| 2,296,598 | A | * | 9/1942 | Cook | 137/210 |
| 2,749,930 | A | | 6/1956 | Whitnall | 137/212 |
| 2,854,826 | A | * | 10/1958 | Johnston | 137/210 |
| 2,919,834 | A | * | 1/1960 | Rugeley et al. | 137/210 |
| 3,520,323 | A | | 7/1970 | Lamb | 137/212 |
| 3,687,176 | A | | 8/1972 | Fernandes et al. | |
| 3,908,861 | A | * | 9/1975 | Johnston | 137/212 |
| RE28,856 | E | * | 6/1976 | Leonard | 137/210 |
| 4,080,996 | A | | 3/1978 | Zahid | |
| 4,089,444 | A | | 5/1978 | Shea | 137/212 X |
| 4,304,526 | A | | 12/1981 | Shetler, Sr. | |
| 4,304,528 | A | * | 12/1981 | Jordan | 137/210 |
| 4,358,026 | A | * | 11/1982 | Makinen | 141/18 |
| 4,425,698 | A | | 1/1984 | Petrie | |
| 4,676,404 | A | | 6/1987 | Yamazaki et al. | 137/212 X |
| 4,848,987 | A | * | 7/1989 | Howard et al. | 141/45 |
| 4,956,975 | A | | 9/1990 | Gustafson | 137/210 X |
| 4,976,162 | A | * | 12/1990 | Kamen | 73/865.9 |
| 5,343,908 | A | * | 9/1994 | Furstenberg | 141/98 |
| 5,365,981 | A | * | 11/1994 | Peschka et al. | 141/45 |
| 6,267,160 | B1 | * | 7/2001 | Viken | 141/98 |
| 6,378,657 | B2 | * | 4/2002 | Viken | 141/65 |
| 6,443,192 | B1 | * | 9/2002 | Erwin et al. | 141/65 |

FOREIGN PATENT DOCUMENTS

| | | | | |
|---|---|---|---|---|
| DE | 966655 | | 5/1957 | 137/210 |
| DE | 19547245 | | 6/1997 | |
| DE | 29722504 | | 2/1998 | |
| GB | 2237844 A | * | 5/1991 | |
| LU | 39909 | | 5/1961 | |

* cited by examiner

*Primary Examiner*—Gregory Huson
*Assistant Examiner*—Khoa Huynh
(74) *Attorney, Agent, or Firm*—Roylance, Abrams, Berdo & Goodman, LLP

(57) ABSTRACT

The invention relates to a device for the removal of fluid from a container (10), which carries a gas and which in the area of a collection point (12) for the liquid has a removal connection (14), to which can be connected a collection container (18) by means of a removal conduit (16), which container can be connected through an equalization conduit (20) with an equalization connection (22) arranged on the container (10), which connection is different from the removal connection (14). In this manner a liquid removal device of small structure is made available as a maintenance unit which can be connected with only very short time period of the container being out of commission and in turn can also be rapidly separated therefrom.

12 Claims, 2 Drawing Sheets

DEVICE FOR REMOVING FLUID FROM A CONTAINER

Figure 1:
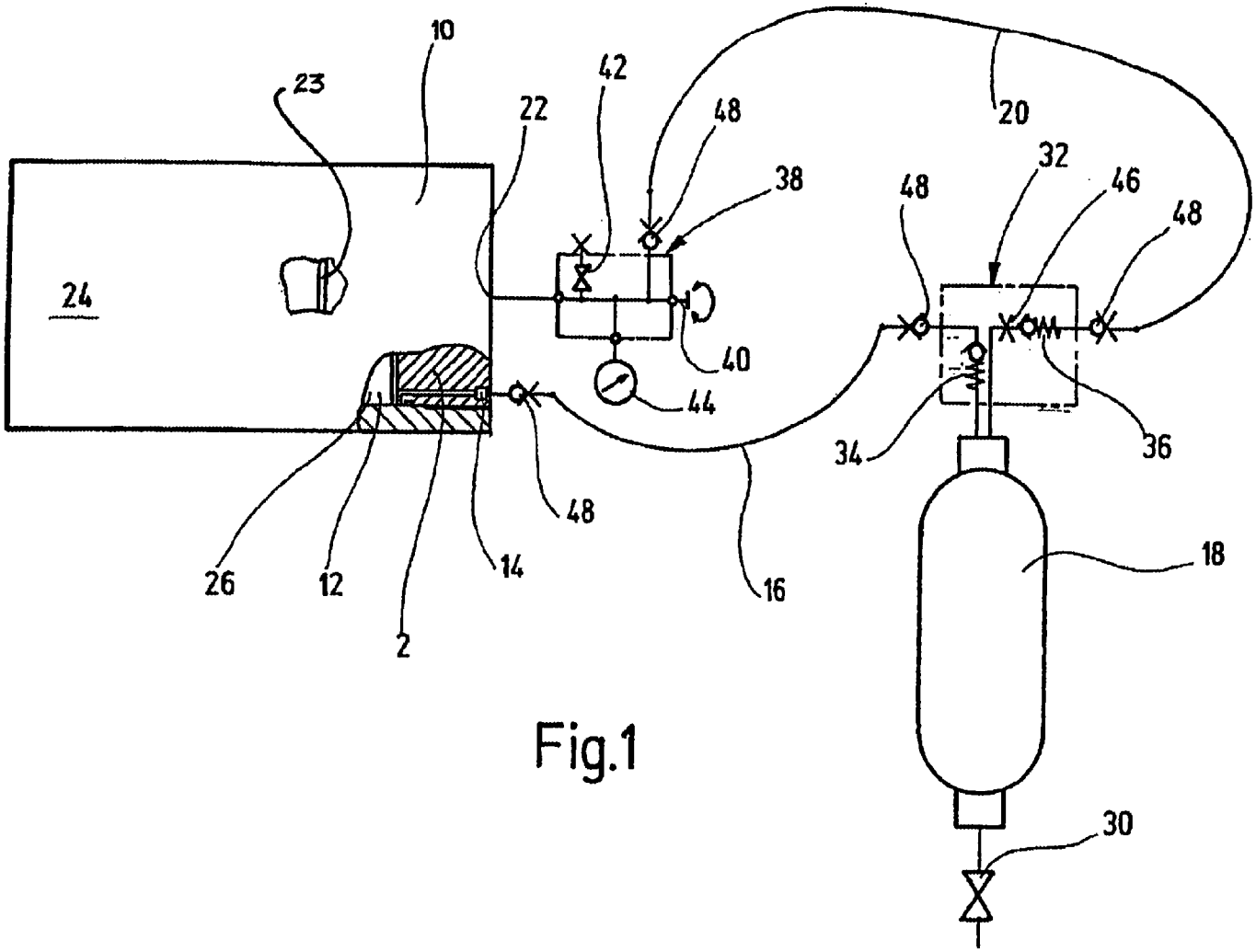

This application is a 371 of PCT/EP01/00608 filed Jan. 19, 2001 which is a continuation of Ser. No. 09/514,388 filed Feb. 28, 2000.

The invention relates to a device for removing fluid from a container which holds gas and which has, in the area of a collecting point for fluid, an extraction connection which may be connected to a collecting container by way of an extraction line, which container may be connected by way of a compensating line to a compensating connection mounted on the container, which compensating connection is different from the extraction connection.

When containers holding gas are used in hydraulic circuits, oil is regularly fed to the gas side of the container, and accordingly fouling with oil occurs on the gas side. The fluid involved may also to some extent include an abrasive substance such as one deriving from movable rubber seals or the like. In addition, the fluid is regularly displaced by the operating gas. If it is desired to extract the fluid in question from the container, one in the form of a piston-type accumulator, for example, especially from the gas side of the container, the entire hydraulic system generally has to be shut down for a lengthy period, or at least the part of the system including the piston-type accumulator to be serviced and to be cleaned. In addition to the protracted system downtime, precise safety regulations must be adhered to, something which on the whole makes the servicing process elaborate and cost-intensive. The conventional servicing equipment, which optionally allows refilling of the gas side of the container with an operating gas, is structurally bulky and difficult to handle.

DE 297 22 504 U discloses a container for gaseous media, especially a large-volume pipeline with an inlet connection and an outlet connection, and with a vent connection and drain connection, the inlet connection and the outlet connection being designed simultaneously as vent and drain connections. The inlet connection comprises two inlet pipes which lead from a side inlet connection of the container in an arc to a high point in the interior of the container, the outlet connection comprising two outlet pipes which extend from a low point in the interior of the container in an arc to a side outlet connection of the container. Conventional containers, generally in the form of large-volume pipelines, are usually classified by general regulations as systems requiring monitoring, ones which are subject to strength and tightness testing with water, identified by the term water pressure testing, before being placed in service.

Such water pressure testing requires, in addition to the customary inlet and outlet connections provided for gas, also separate vent and drain connections at the high point and low point of the container, on its exterior wall. The conventional solution may dispense with separate vent and drain connections for water filling free of air, otherwise previously customary in the state of the art, so that complete discharge of water, as well as largely emission-free charging with natural gas, can be achieved, something which otherwise is partly responsible, especially in the form of methane losses, for enlargement of the ozone hole. Use of the conventional container as servicing unit for other containers is neither provided nor possible.

On the basis of this state of the art the object of the invention is to make available a compact fluid removal device as servicing unit, a device which may be connected to and again separated from the container after very short downtimes, in order distinctly to reduce the overall servicing time and the accompanying servicing costs. The object as formulated in these terms is achieved with a device having the features specified in claim 1.

The device is operated in such a way that, after being connected on the basis of the prevailing pressure differences between the container and the collecting container of the device, the fluid, which optionally may contain gas, is removed from the container and transferred to the collecting container. The collecting container then permits preferably a process of settling of the components of the fluid, in particular in the form of fouled fluid, it being possible for the gas components to flow back by way of the compensating line and compensating connection to the gas side of the container. As a result a sort of closed cycle is established, one which permits continuous operation of the device without hampering the oil removal process as a result of undesired pressure rises or the like. Since the compensating connection is in any event present with every container used for a gas refilling process, all that the container requires in addition is installation at a deep point in the container of an extraction connection different from the compensating connection, the fluid containing the gas being collected at the extraction connection. The device claimed for the invention can be quickly connected to and disconnected from the container by quick-release coupling equipment, so that the extraction process [proceeds] very quickly and the length of time that the device is shut down is quite limited. A compact design for the entire device can be achieved in particular when an oil collecting container of quite small dimensions is used. Furthermore, as compared with conventional solutions, only a small loss of gas occurs on the gas side of the container since dissolved nitrogen accrues only in the fluid, which is present especially in the form of oil, and concentrated or compressed nitrogen is found only in the residual gas area of the collecting container in terms of the only gas loss for the container.

Various advantageous embodiments are the object of the dependent claims.

Hereinafter the device according to the invention is to be explained in greater detail relative to two exemplary embodiments.

Figure 2:
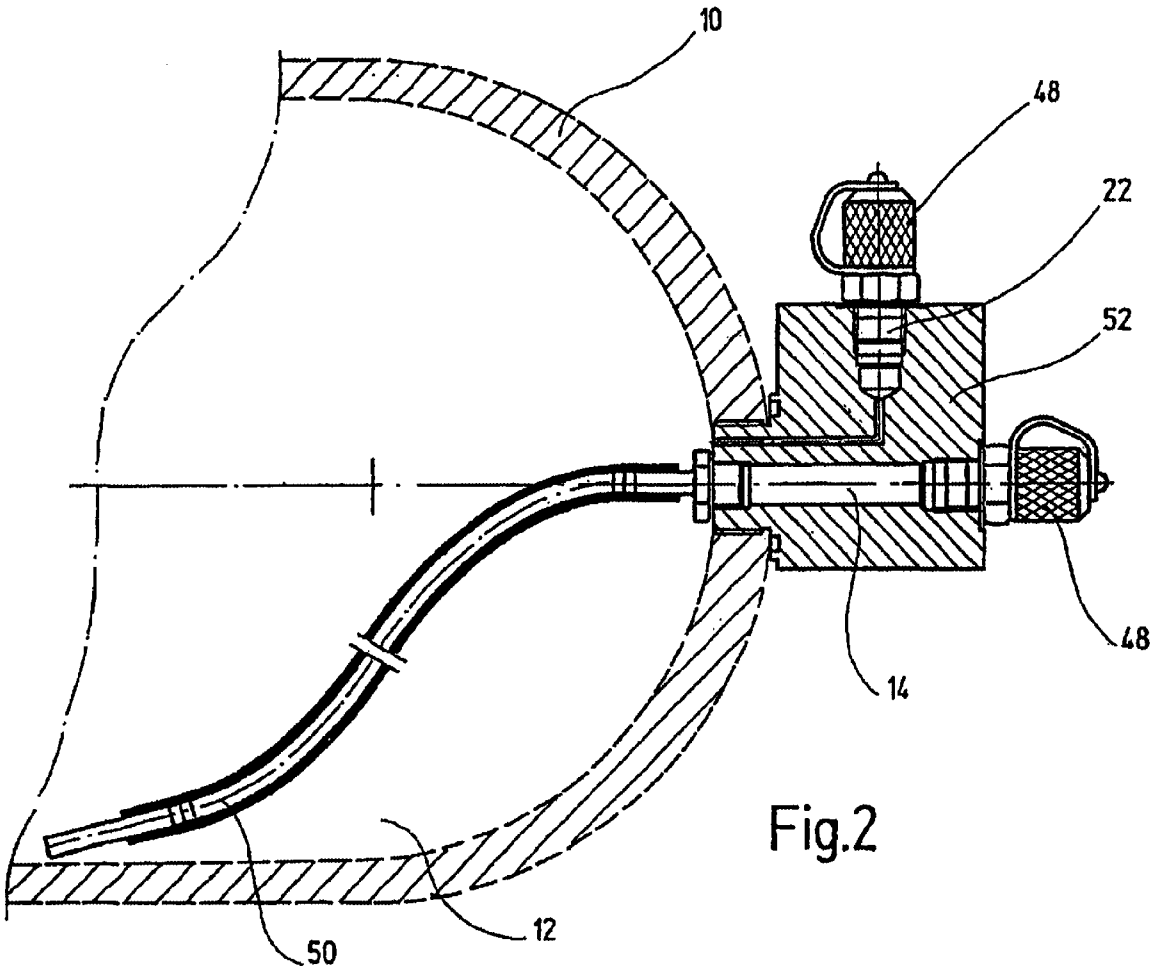

In the drawing, the following are represented in principle and not according to scale:

FIG. 1 a connection plan of the device showing it in connection with a floating piston reservoir;

FIG. 2 a partial representation of a cross section through a nitrogen reservoir with its connections for the connection of the liquid removal device as shown in FIG. 1.

The device shown in FIG. 1 serves for the removal of liquid, especially removal of oil used for hydraulic power, from a container 10, which also contains a gas, especially in the form of gaseous nitrogen. In the area of a collection point 12 for the liquid which is to be replaced with the working gas and therefore is present in foamed condition is located a removal connection 14, to which can be connected a collection container 18 through a removal conduit 16, which container 18 in turn can be connected through an equalization conduit 20 with an equalization connection 22 arranged on container 10, which connection 22 is different from the aforementioned removal connection 14. The container shown in FIG. 1 represents what is termed a hydraulic reservoir in the form of a floating piston reservoir with a separating element, not shown, which in this case separates the liquid side 24 from the gas side 26 of the container in a traditional manner, for which purpose the floating piston reservoir and consequently container 10 is held in horizontal alignment in such a manner that removal connection 14 opens in the cover 28 of container 10 on its gas side 26, and actually in the lowest area, in other words at the bottommost point of the reservoir.

Removal connection 14 is particularly configured as a sort of a tap line, which engages through cover 28 and then bends downward at a right angle as seen in FIG. 1 and there opens in gas side 26. By this means it is guaranteed that with horizontal alignment of the structure the liquid removal process takes place effectively at the bottommost point of container 10, whereby the liquid in the form of hydraulic oil is precipitated downward by the force of gravity and collects at the collection point 12. An O-ring gasket is arranged in cover 28 between the bending downward of tap-like removal connection 14 and the surrounding environment, where the O-ring seals cover 28 from the interior of the housing of container 10. Insofar as the oil removal device is being used with a floating piston reservoir, oil passes continuously in any case from liquid side 24 through the gaskets of the separating element, not shown, to gas side 26 and consequently leads to contamination of the working gas with the liquid. The liquid too can be contaminated by the abrasion material in the packing in the form of a gasket on the separating element. Furthermore the fluid being precipitated at collection point 12 is being replaced with the working gas and therefore is present in foamed condition. Removal connection 14 is to be introduced into cover 28 on the production side, whereby the resulting additional outlay for construction is low. An equalization connection 22 on the other hand is present with each container 10, since it generally serves for the refilling of the working gas, insofar as this gas for example in the case of a floating piston reservoir passes through the gasket system of the separating element to the liquid side 24 of the reservoir. Consequently a connection which is already present on the container side is used for equalization connection 22, so that no further costs are generated as a result of further construction.

On the bottom of collection container 18 is found a shut-off valve 30 which allows the fluid precipitated in collection container 18 if necessary together with the contaminants to be discharged from collection container 18. At the top of collection container 18 is connected a valve device indicated in its entirety as 32 and including a first spring-biased check valve 34 between removal conduit 16 and collection container 18 as well as a second spring-biased check valve 36 between container 18 and equalization conduit 20. With this arrangement, the direction of opening of first check valve 34 is in the direction of collection container 18 and the direction of opening of second check valve 36 is away from collection container 18 in the direction of equalization conduit 20. Furthermore in equalization conduit 20 between collection container 18 and container 10 is connected a filling and testing device which is indicated in its entirety as 38, which is actually preferably located directly on equalization connection 22 of container 10. This filling and testing device 38 is not absolutely necessary, but makes the process of liquid removal from the container more secure and more convenient for the operator.

The filling and testing device particularly can have an operating screw 40 which can be rotated in both directions according to the double arrow as shown in the representation to cause an opening or closing of equalization connection 22 of container 10, conventionally working through a control valve arrangement, for example in the form of a controllable, spring-biased check valve, not shown. Consequently the filling and testing device 38 can be connected fluid carrying to equalization connection 22 on the gas side by means of operating screw 40. A release valve 42 on filling and testing device 38 allows pressure release in equalization conduit 20 and is to be closed upon closing and operation of the removal device. The relevant pressure conditions allow monitoring of filling and testing device 38 through a manometer 44.

In order to simplify and accelerate the removal process in terms of the pressure situation, a throttle point or restriction gate 46 is present on the equalization side of collection container 18 between this container and second check valve 36, the restriction gate especially in the form of a diaphragm. However in one not shown embodiment it is also possible to form the throttle point or restriction gate 46 of a gas-filter material, for example of a dry, powdered metal, in order thus to clean out the liquid remaining in the working gas for the return into container 10 through equalization conduit 20. Furthermore all essential component parts of the device are connected with one another through rapidly separable traditional rapid coupling devices 48 according to the representation in FIG. 1, whereby with the separation of the component parts of the device from one another, check valves accordingly close and seal the opening setting which has thus been produced making it liquid-tight. Such rapid coupling devices 48 are traditional, so that at this point they are not to be discussed in any further detail.

In order to better understand the oil removal process in the case of the floating piston reservoir, a connection and removal process is to be explained hereinafter in greater detail.

For the connection of the device it is recommended to stop the relevant machine which is connected to the floating piston reservoir or container 10. Then the shut-off valve 30 on the bottom of collection container 18 is closed and the filling and testing device 38 is connected to the gas-side filling connection of the reservoir, in other words to equalization connection 22 of container 10. As a next step the pressure reducing valve 42 of filling and testing device 38 is to be closed and operating screw 40 to be rotated into a setting for opening the gas valve. The tubular removal conduit 16 is then connected by means of rapid coupling device 48 to removal connection 14 of container 10. Finally the connected machine can be started up again.

The machine now works again between pressure levels PI and P2, whereby the liquid replaced with the gas, which liquid has been collected at collection point 12, is conducted out of the tap line forming removal connection 14 and removal conduit 16 and into collection container 18 when first check valve 34 is opened. The perpendicularly arranged collection container 18 then, by condensation and precipitation processes of the oil component parts in the direction of shut-off valve 30, allows separation of the transfer mixture and the released gas component parts can be brought back out of collection container 18 as highly volatile component parts passing through second check valve 36 and equalization conduit 20 as well as filling and testing device 38 on the gas side 26 of container 10. The resulting separation process is further assured by having restriction point 46 located and set in the direction of the discharge. Following a predeterminable time period and dependent upon the degree of filling of collection container 18 with oil, the oil removal device can be again uncoupled and the collected liquid can be drained from collection container 18 through shut-off valve 30, so that the device can be available again for another oil removal process and also can be used with other containers.

For separation of the device from container 10 as before it is recommended to stop the connected machine and as next step to uncouple removal conduit 16 from container 10 by means of rapid coupling device 48. Finally the screw of the gas valve is closed by means of operating screw 40. Then release valve 42 is operated and thereafter the pressure is lowered on the manometer 44 to 0 bar, whereupon the filling and testing device 38 together with equalization conduit 20 is separated from container 10. Following the separation, the machine together with the associated floating piston reservoir can be returned to operation. The removal device is of small construction and for its connection and its removal requires only short time periods of placing the relevant machine out of commission. Furthermore any gas loss occurring with the oil removal is compensated on the gas side by means of the equalization area of the device.

The device according to the invention need not be limited to use with hydraulic reservoirs or the like according to the use as shown in FIG. 1, but rather can generally be used for any container 10 containing gas, insofar as such containers are subject to liquid or oil contamination in the area intended for the gas.

In the embodiment shown in FIG. 28 so-called nitrogen reservoir is provided as container 10, whereby in this case the structural parts which correspond basically to the component parts of the structure shown in FIG. 1 are indicated with the same references. The provisions involved in the first embodiment are therefore once again in effect insofar as the partial representation of FIG. 2 showing the second embodiment is in accordance with the first embodiment. In the interior of the storage reservoir configured as container 10 a removal device in the form of a flexible, likewise gravity-operated removal tube 50 is connected to removal connection 14. Removal tube 50 is selected according to its length, so that independent of the horizontal arrangement of the storage reservoir configured as container 10 it always reaches the lowest point of said storage reservoir, in order thus to be able in the area of collection point 12 to receive the precipitated liquid and likewise at the same time in turn to be able to replace said liquid with the working gas for a removal process. Considering the fact that removal tube 50 is maintained flexible, it can execute a possible rotary movement of the storage reservoir as container 10, insofar as this reservoir assumes a different horizontal structural positioning than that shown in FIG. 2. Thus, with the storage reservoir in any essentially horizontal structural position, it is guaranteed that removal tube 50 having its free end reaching in a liquid-carrying manner opens into collection point 12 which is provided to collect the possibly contaminated liquid to be removed, and is provided with the working gas. Equalization connection 22 in this case is configured as a sort of an offset tap line and opens in the gas area of collection container 10, whereby equalization connection 22 in turn is required to be separate from removal connection 14. The removal device according to the representation shown in FIG. 1 with its collection container 18 is then in turn connected in a corresponding manner to connections 14 and 22 through rapid coupling device 48 and is ready for operation.

Basically it is also possible to disengage the nitrogen reservoir as container 10 in perpendicular structural manner by freeing it of liquid. In the resulting case, not shown, equalization connection 22 would then serve as removal connection 14 and likewise the prevailing removal connection 14 would serve as equalization connection 22, whereby removal tube 50 then would be replaced by a standpipe as a stationary structural part which reaches a considerable distance into the interior of container 10 on the gas side. The exchanged connections 14 and 22 would then be arranged at the bottommost point of container 10 serving as storage reservoir, whereby connection block 52, which is mounted on the storage reservoir and contains connections 14 and 22, would represent the bottommost point of the storage reservoir. Since connection block 52 with its connections 14 and 22 could be standardized in its dimensions, even the already presently used nitrogen reservoir systems can thus be provided to be of low cost and be subjected to an oil removal process by means of the removal device of the invention.

What is claimed is:

1. A device for removing fluid from a container, comprising:

an accumulator having a piston separating a gas side and a hydraulic fluid side inside said accumulator;

an extraction connection coupled to said gas side of said accumulator at a collecting area at a deepest point in said accumulator;

a collecting container connected by an extraction line to said extraction connection;

a compensation connection on said accumulator separate from said extraction collection; and a compensation line connecting said collecting container to said compensation connection.

2. A service according to claim 1 wherein said gas side stores nitrogen as an operating gas; and an extraction device producing a fluid conducting connection to said collecting area is connected to an interior of said extraction connection.

3. A device according to claim 2 wherein said extraction device is a flexible hose extending into said collecting area independently of installed positions of said accumulator; and said compensation connection comprises a standpipe.

4. A device according to claim 1 wherein said gas side stores nitrogen as an operating gas;

said extraction connection ends in said collecting area; and a compensating device is connected to said compensation connection to discharge gas into said gas area.

5. A device according to claim 1 wherein said accumulator is substantially horizontal; and said extraction connection is mounted at the deepest point of said accumulator.

6. A device according to claim 1 wherein said compensation connection comprises a conventional gas connection on said accumulator.

7. A device according to claim 1 wherein a pressure differential inside said extraction line acts in a direction of said collecting container, at least during an extraction process from said accumulator.

8. A device according to claim 1 wherein a filling and testing device is connected directly to said compensation connection and is inserted into said compensation line between said accumulator and said collecting container.

9. A device according to claim 1 wherein a first non-return valve is in fluid communication between said extraction line and said collecting container, and opens in a direction of said collecting container; and a second non-return valve is mounted between the compensation line and the collecting container, and opens in a direction of said compensation line.

10. A device according to claim 9 wherein a throttle point is located between said second non-return valve and said collecting container.

11. A device according to claim 10 wherein said throttle point is a diaphragm.

12. A device according to claim 10 wherein said throttle is a filter.

* * * * *